US007625293B2

(12) United States Patent
Jago

(10) Patent No.: US 7,625,293 B2
(45) Date of Patent: Dec. 1, 2009

(54) CUE BALL ENTERTAINMENT GAME

(76) Inventor: Neil R. Jago, 66 Powlett Road, Hartlepool (GB) TS24 8NA ( * ) Notice: Subject to any disclaimer, the term of this patent is extended or adjusted under 35 U.S.C. 154(b) by 546 days.

(21) Appl. No.: 11/474,034

(22) Filed: Jun. 23, 2006

(65) Prior Publication Data

US 2007/0298894 A1 Dec. 27, 2007

(51) Int. Cl.
*A63D 15/00* (2006.01)

(52) U.S. Cl. ..... 473/29; 473/1; 473/4

(58) Field of Classification Search ..... 473/1, 473/4, 18, 29; 463/1, 6, 9; 273/108, 118 R, 273/118 A, 123 R, 123 A
See application file for complete search history.

(56) References Cited

U.S. PATENT DOCUMENTS 1,967,217 A * 7/1934 Amsden ..... 273/108.4
3,711,099 A * 1/1973 Milu ..... 273/123 R
3,825,258 A * 7/1974 Frierman ..... 473/3
3,889,945 A * 6/1975 Ellis ..... 473/15
4,120,494 A 10/1978 Roe
4,524,969 A * 6/1985 Erzmoneit ..... 473/17
4,834,384 A * 5/1989 Cortesi ..... 273/123 R
4,840,376 A * 6/1989 Garret ..... 473/1
5,026,053 A * 6/1991 Paterson et al. ..... 473/23
5,066,008 A * 11/1991 Rivera ..... 473/23
5,505,665 A * 4/1996 Bumstead ..... 473/1
5,653,640 A 8/1997 Shirley, Jr.
5,685,779 A * 11/1997 Tsoukalas ..... 473/1
5,738,591 A * 4/1998 Opsal ..... 473/4
5,765,828 A 6/1998 Baker et al.
2008/0269925 A1* 10/2008 Lita ..... 700/92

* cited by examiner

*Primary Examiner*—Raleigh W. Chiu
(74) *Attorney, Agent, or Firm*—Raymond M. Galasso; Galasso & Associates, L.P.

(57) ABSTRACT

Q Ball consists of at least some of the following: a tabletop attached to a base and having pockets and bumper rails, touch screen visual display units, and a felt surface. Q Ball also utilizes cue and object balls, break lines and a center dot on the felt surface, color emblems on the edges of the table, and a rack. Two or more players alternate turns attempting to pocket object balls by striking a cue ball into the object balls. Whenever a player pockets the appropriate object ball, he attempts to answer a trivia question from the touch screen visual display units. If he is successful, he gets to shoot again. The winner is the player that pockets all of the appropriate object balls first.

4 Claims, 1 Drawing Sheet

CUE BALL ENTERTAINMENT GAME

CROSS-REFERENCE TO RELATED APPLICATIONS

This Non-Provisional Patent Application does not claim priority to any United States provisional patent application or any foreign patent applications.

FIELD OF THE DISCLOSURE

The disclosures made herein relate generally to the entertainment industry. The invention discussed herein is in the general classification of bar and billiards games.

BACKGROUND

Many people frequent bars to relax after busy or stressful days. In many bars, a variety of games of skill or intellect are available to entertain patrons. Billiards, video games, including trivia machines, darts, foosball and shuffleboard are examples of some of the games most frequently available.

Often people even choose to purchase these types of games for home entertainment. A basement, family room, or game room can be an excellent retreat for families to play one or more of these types of games.

Pool or billiards is one of the most popular games of skill. A variety of pool or billiards games have been invented. However, all of them involve a player striking a cue ball with a cue stick with the intent of knocking either a striped or colored object ball into one of several pockets placed around the perimeter of the pool table.

Trivia games are one of the most popular types of intellectual games. Many types of trivia games exist. One of the more popular of these games involves the use of a touch screen. After money is inserted into a trivia machine, a user can select a variety of different trivia topics. Then, a question related to the selected topic is displayed for a player for a set amount of time with several multiple choice answers listed beneath the question. The player attempts to press the letter on the screen that corresponds with the correct answer to the displayed question.

A variety of interactive, multiple choice trivia games are also available in many bars. These games utilize hand units to allow a multitude of players within a bar or at different bars to compete against each other.

The games discussed herein, such as pool or trivia, are either games of skill or intellect. None of these games commonly seen at bars or in homes combine skill and intellect into one game.

Hence, there is a need in the art for an easy to use, affordable game of both skill and intellect that combines pool and trivia.

SUMMARY OF THE DISCLOSURE

Q Ball is a game that utilizes a table with pockets and rails, touch screen visual display units, a felt surface, and cue and object balls.

The principal object of this invention is to provide an easy to use billiard-type game with a trivia component.

Another object of this invention is to provide an affordable game that is easy to learn and play.

Yet another object of this invention is to provide a game that combines both skill and intellect.

DETAILED DESCRIPTION OF THE DRAWINGS

Q Ball consists of at least some of the following: a table with legs, pockets and bumper rails, touch screen visual display units, a felt surface, cue and object balls, break lines and a center dot on the felt surface, color emblems on the edges of the table, and a square rack.

Figure 1:
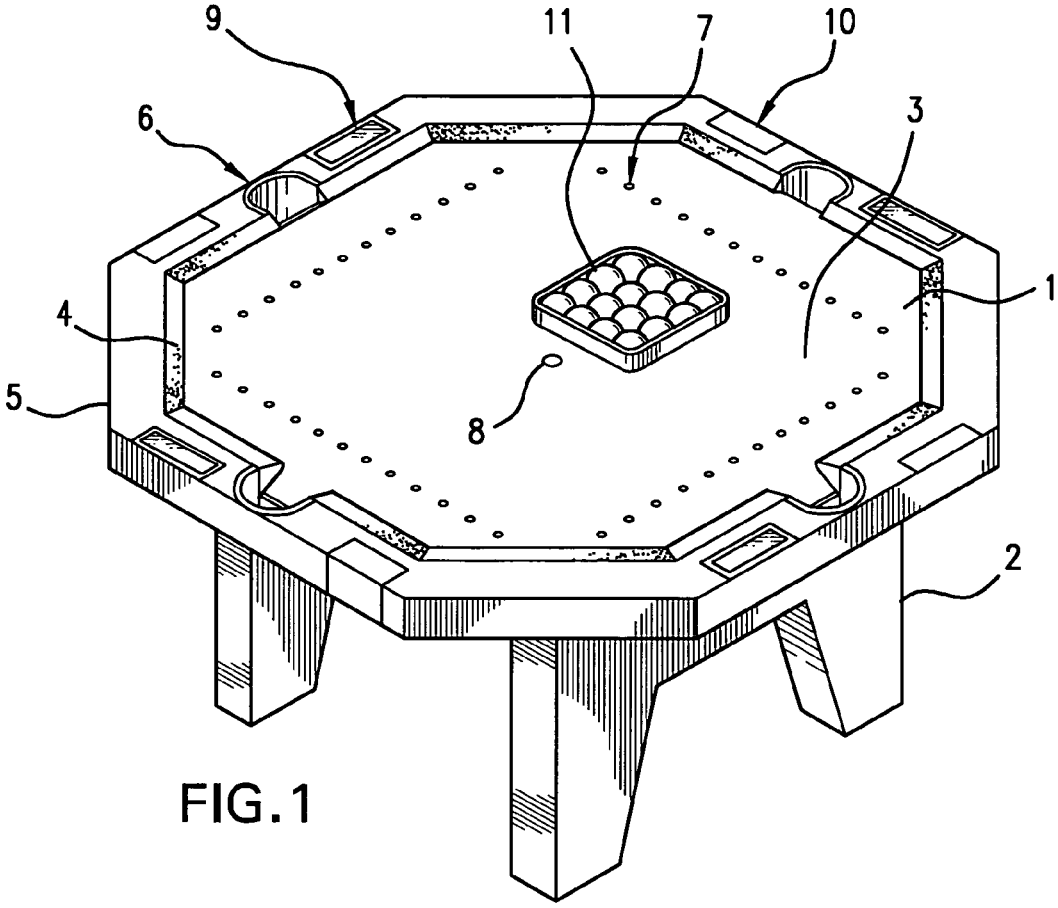
FIG. 1 depicts a perspective view of the preferred embodiment of the present invention.

FIG. 1 depicts the preferred embodiment of the invention. It consists of an octagonal tabletop 1 with four legs 2 as a base. The legs 2 are made of wood. The octagonal tabletop 1 has a felt covering 3 with raised bumper rails 4 along the perimeter. The raised bumper rails 4 are attached to a set of edges 5 surrounding the octagonal tabletop 1. Four pockets 6 are located within the set of edges 5 and beneath the felt covering 3. The four pockets 6 are evenly spaced along the perimeter of the octagonal tabletop 1 such that each pocket is directly opposite another pocket. Each pocket has a fabric net (not pictured) for catching and storing the balls used for playing the game.

The felt covering 3 has a variety of markings on it to aide in playing the game. A set of four break lines 7 is located in front of each of the pockets. A dot 8 is located in the center of the felt covering 3.

A touch screen visual display unit 9 is located on one side of each pocket. The visual display unit 9 is wired with an insulated cord and metal adaptors to a central computer. A color marker 10 with an emblem corresponding to one of four sets of object balls is located on the other side of each pocket.

Figure 2:
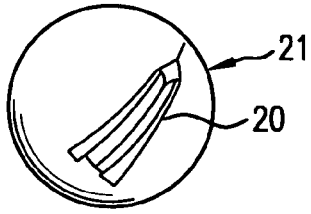
FIG. 2 depicts a perspective view of the preferred embodiment of one ball in the first set of object balls of the present invention.

FIG. 2 depicts a perspective view of the preferred embodiment of one ball in the first set of object balls. There are four balls in this first set of object balls. A silver rocket 20 is located on two opposite sides of each ball in this set. The first set of object balls has a purple background 21. These object balls are made of a hard plastic or phenolic resin and are approximately 2¼ inches in diameter and weigh six ounces.

Figure 3:
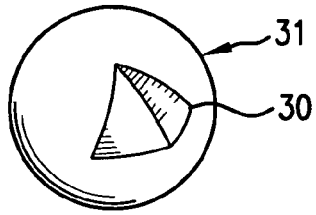
FIG. 3 depicts a perspective view of the preferred embodiment of one ball in the second set of object balls of the present invention.

FIG. 3 depicts a perspective view of the preferred embodiment of one ball in the second set of object balls. Again, there are four balls in this second set of object balls. A gold pyramid 30 is located on two opposite sides of each ball in this set. The second set of object balls has a black background 31. These object balls are made of a hard plastic or phenolic resin and are approximately 2¼ inches in diameter and weigh six ounces.

Figure 4:
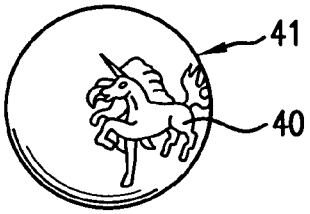
FIG. 4 depicts a perspective view of the preferred embodiment of one ball in the third set of object balls of the present invention.

FIG. 4 depicts a perspective view of the preferred embodiment of one ball in the third set of object balls. Four balls comprise this third set of object balls as well. A white unicorn 40 is located on two opposite sides of each ball in this set. The third set of object balls has an orange background 41. These object balls are made of a hard plastic or phenolic resin and are approximately 2¼ inches in diameter and weigh six ounces.

Figure 5:
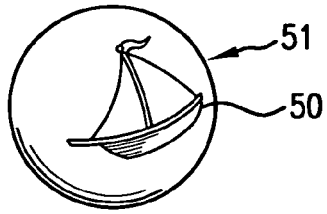
FIG. 5 depicts a perspective view of the preferred embodiment of one ball in the fourth set of object balls of the present invention.

FIG. 5 depicts a perspective view of the preferred embodiment of one ball in the fourth set of object balls. There are also four identical balls in this set. A blue ship 50 is located on two opposite sides of each ball in this set. The fourth set of object balls has a cream background 51. These object balls are made of a hard plastic or phenolic resin and are approximately 2¼ inches in diameter and weigh six ounces.

Q Ball also utilizes a white cue ball (not pictured) that is approximately the same size and weight as the object balls. The total of sixteen object balls can be gathered using a square rack 11 as shown in FIG. 1. In the preferred embodiment, the square rack 11 is made of wood.

In an alternative embodiment of the invention, the table would have only two sets of object balls, two touch screen visual display units, two pockets and two color emblems corresponding to the appropriate set of object balls. This design would be ideal for a two-player game. In this alternative embodiment, a color emblem corresponding to one of the sets of object balls would be located on one side of the pockets while one of the touch screen visual display units would be located on the other side of the pockets. The two pockets would be directly opposite one another on the table. In this alternative embodiment, there would be eight object balls in each set rather than four.

To play the game, players would choose an emblem and set up the sixteen balls within the rack on the center dot. One player would set up the cue ball behind his break line and break the balls in the traditional manner of any billiards game. If the player that breaks the balls pockets one of the balls with his selected emblem, he attempts to answer a trivia question. If he does not pocket a ball with the appropriate emblem, the player to his left attempts to pocket a ball with his emblem.

Whenever a player pockets a ball with his emblem, he attempts to answer a trivia question. If he is successful, he gets to shoot again. The winner is the player that pockets all of the balls with his assigned emblem on them.

The touch screen visual display units are pressed after a ball is pocketed. A question is displayed along with three answer choices and a horizontal bar that gradually shrinks over a thirty-second time period. The player has thirty seconds to touch the correct answer on the screen. If he touches the incorrect answer choice or the thirty seconds elapse without him making a choice, his turn is over and the player to his left attempts to shoot a ball with his assigned emblem on it into a pocket. After an erroneous selection is made or the time elapses, the correct answer flashes on the screen.

The components of Q Ball may vary widely but will likely utilize wood, fabric, metal, plastic, and electrical components. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Q Ball can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

All electronic components of the invention will also be ideally selected from those currently having the highest industry ratings. These components will also meet and/or exceed all safety and usage regulations. Wiring and associated connecting hardware should be insulated and otherwise protected from intrusion by any harmful or degrading elements, including water, medium level temperatures, and low to medium impact force.

The size of the Q Ball table may vary widely. The preferred embodiment is approximately thirty-two inches high and each edge of the octagonal tabletop is approximately three feet long. It should be obvious, however, that any table shape or size table could be utilized. Q Ball could also be coin operated in the same manner that traditional pool tables are operated. Q Ball could utilize a coin slot operatively attached to the table that releases balls from a receptacle beneath the table after coins are inserted, as is well known in the art.

It should further be obvious that any suitable material could be used for the balls used with the present invention. The size and weight of the balls may also vary. Moreover, the rack could be made of plastic or any other suitable material and could be of a variety of shapes. It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An entertainment game comprising:

(a) a tabletop connected to a base and having a set of raised bumper rails attached to a set of edges around the periphery of the tabletop;

(b) a pocket located on the periphery of the tabletop;

(c) a touch screen visual display unit located on the periphery of the tabletop; and (d) a first set sets of object balls and a cue ball wherein the pocket has a fabric net.

2. The entertainment game of claim 1 further comprising a coin slot located on the base.

3. The entertainment game of claim 2 wherein the pocket connects to a chute that connects to a receptacle located beneath the table.

4. An entertainment game comprising:

(a) an octagonal table with a felt covering and a set of raised bumper rails attached to a set of edges around the perimeter of the octagonal tabletop;

(b) a first pocket with a first fabric net, a second pocket with a second fabric net, a third pocket with a third fabric net, a fourth pocket with a fourth fabric net located on the periphery of the tabletop;

(c) a first touch screen visual display unit, a second touch screen visual display unit, a third touch screen visual display unit and a fourth touch screen visual display unit located on the periphery of the tabletop;

(d) a first set of object balls, a second set of object balls, a third set of object balls, a fourth set of object balls and a cue ball;

(e) a plurality of wooden legs attached to the octagonal tabletop;

(f) a rack for gathering the first set of object balls, second set of object balls, third set of object balls, and fourth set of object balls, and (g) said felt covering having a dot in the center and a plurality of break lines.

* * * * *